US009808947B2

(12) United States Patent
Grubka et al.

(10) Patent No.: US 9,808,947 B2
(45) Date of Patent: Nov. 7, 2017

(54) ROOFING SHINGLE SYSTEM

(71) Applicant: Owens Corning Intellectual Capital, LLC, Toledo, OH (US)

(72) Inventors: Lawrence J. Grubka, Westerville, OH (US); Carmen A. LaTorre, Worthington, OH (US); Bert W. Elliott, Toledo, OH (US); Christopher C. Freidner, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/979,808

(22) Filed: Dec. 28, 2015

(65) Prior Publication Data

US 2016/0186436 A1 Jun. 30, 2016

Related U.S. Application Data

(60) Provisional application No. 62/097,775, filed on Dec. 30, 2014.

(51) Int. Cl.

| | |
|---|---|
| ***B26D 3/10*** | (2006.01) |
| ***E04D 1/26*** | (2006.01) |
| *E04D 1/00* | (2006.01) |
| *B26D 1/40* | (2006.01) |

(52) U.S. Cl.

CPC ..... *B26D 3/10* (2013.01); *E04D 1/26* (2013.01); *B26D 1/405* (2013.01); *E04D 2001/005* (2013.01)

(58) Field of Classification Search

CPC ..... E04D 1/26; E04D 2001/005; E04D 1/00; E04D 1/12; B26D 3/10; B26D 1/405

See application file for complete search history.

(56) References Cited

U.S. PATENT DOCUMENTS

| | | | | |
|---|---|---|---|---|
| 1,464,492 A | | 8/1923 | Busha | |
| 1,495,070 A | | 5/1924 | Finley | |
| 1,500,709 A | * | 7/1924 | Keller | E04D 1/26 52/554 |

(Continued)

FOREIGN PATENT DOCUMENTS

| | | |
|---|---|---|
| CA | 946583 | 5/1974 |
| CA | 961621 | 1/1975 |
| CA | 2284171 | 3/2001 |

*Primary Examiner* — Adriana Figueroa
*Assistant Examiner* — Jessie Fonseca
(74) *Attorney, Agent, or Firm* — Calfee, Halter & Griswold LLP

(57) ABSTRACT

A roofing system including shingles with different shingle patterns. The roofing system may include a plurality of first shingles having a first two-tab shingle pattern and a plurality of second shingles having a second two-tab shingle pattern. The first shingles including a first tab having a first width and a second tab having a second width, wherein the first width and the second width are substantially equal. The second shingles including a third tab having a third width and a fourth tab having a fourth width, wherein the third width is substantially equal to the first width and the fourth width is about double the second width. The plurality of first shingles and the plurality of second shingles can be formed from a rectangular shingle blank in an interwoven pattern with substantially no scrap or waste material.

10 Claims, 6 Drawing Sheets

(56) References Cited

U.S. PATENT DOCUMENTS 1,629,146 A 5/1927 Busha
1,666,204 A * 4/1928 Harshberger ..... E04D 1/26 83/32
RE17,187 E * 1/1929 Perry ..... E04D 1/26 52/559
1,846,635 A 2/1932 Finley
1,862,852 A 6/1932 Harshberger
1,894,614 A * 1/1933 Wettlaufer ..... E04D 1/26 52/553
1,937,933 A * 12/1933 Yeager ..... E04D 1/26 52/559
1,974,047 A * 9/1934 Harshberger ..... E04D 1/26 52/555
2,013,391 A 9/1935 Searls
2,068,118 A * 1/1937 Topping ..... E04D 1/26 52/555
2,069,444 A * 2/1937 Honigbaum ..... E04D 1/26 52/524
2,171,010 A * 8/1939 Schuetz ..... E04D 1/26 52/105
2,174,098 A * 9/1939 Stein ..... E04D 1/26 52/559
2,197,972 A 4/1940 Ernst
3,407,556 A * 10/1968 Leibrook ..... E04D 1/26 52/559
3,613,328 A * 10/1971 Morgan, Jr. et al. ..... E04D 1/26 52/555
3,624,975 A * 12/1971 Morgan et al. ..... E04D 1/26 52/105
3,927,501 A * 12/1975 Allen ..... E04D 1/26 52/105
4,195,461 A 4/1980 Thiis-Evensen
4,499,702 A * 2/1985 Turner ..... E04D 1/26 52/555
5,577,361 A * 11/1996 Grabek, Jr. ..... E04D 1/26 52/543
6,010,589 A 1/2000 Stahl et al.
6,038,827 A 3/2000 Sieling
6,220,329 B1 4/2001 King et al.
6,457,290 B1 * 10/2002 Elliott ..... E04D 1/26 427/188
8,438,812 B2 5/2013 King et al.
9,140,012 B1 * 9/2015 Leitch
2004/0123537 A1 * 7/2004 Elliott ..... E04D 1/26 52/314
2004/0123543 A1 * 7/2004 Elliott ..... E04D 1/26 52/518
2005/0000335 A1 * 1/2005 Freshwater ..... B26D 3/10 83/37
2006/0260731 A1 * 11/2006 Kalkanoglu ..... B26D 5/34 156/64
2007/0068108 A1 3/2007 Kiik et al.
2008/0005995 A1 * 1/2008 Elliott ..... E04D 1/26 52/557
2010/0000587 A1 1/2010 Lemon
2012/0258282 A1 * 10/2012 Hammond ..... C04B 26/26 428/143

* cited by examiner

ROOFING SHINGLE SYSTEM

CROSS REFERENCE TO RELATED APPLICATIONS

The present application claims the benefit of U.S. Provisional Patent Application Ser. No. 62/097,775, filed on Dec. 30, 2014, the disclosure of which is incorporated herein by reference in their entireties.

FIELD OF THE INVENTION

The present application generally relates to roofing shingle systems and, more particularly, to roofing shingle systems incorporating two or more shingles with different shingle patterns.

BACKGROUND OF THE INVENTION

Roofing materials, such as roofing shingles, are installed on the roofs of buildings to provide protection from the elements and to give the roof an aesthetically pleasing look. Two of the most common shingle styles offered in residential roofing are single layer, three-tab shingles and multilayer architectural or laminate shingles. Single layer, three-tab shingles generally include a single substrate constructed to be flat without any dimensional thickness and include three individual equal width tabs cut into the portion of the shingle that is exposed when installed on a roof.

Architectural or laminate shingles generally include two substrates laminated together with tabs of varying widths formed in the exposed area, and typically slightly different shades of color, to give a more dimensional appearance that is often considered more aesthetically pleasing than conventional three-tab shingles.

SUMMARY OF THE INVENTION

A roofing system including shingles with different shingle patterns. In one exemplary embodiment, the roofing system includes a plurality of first shingles having a first two-tab shingle pattern and a plurality of second shingles having a second two-tab shingle pattern. The first shingles including a first tab having a first width and a second tab having a second width, wherein the first width and the second width are substantially equal. The second shingles including a third tab having a third width and a fourth tab having a fourth width, wherein the third width is substantially equal to the first width and the fourth width is about double the second width. The plurality of first shingles and the plurality of second shingles can be formed from a rectangular shingle blank in an interwoven pattern with substantially no scrap or waste material.

In another exemplary embodiment, the roofing system includes a plurality of third shingles having a third two-tab shingle pattern. The third shingles including a fifth tab having a fifth width and a sixth tab having a sixth width, wherein the fifth width is substantially equal to the first width and the sixth width is about 1.5 times the second width.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

BRIEF DESCRIPTION OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION OF THE INVENTION

Figure 1:
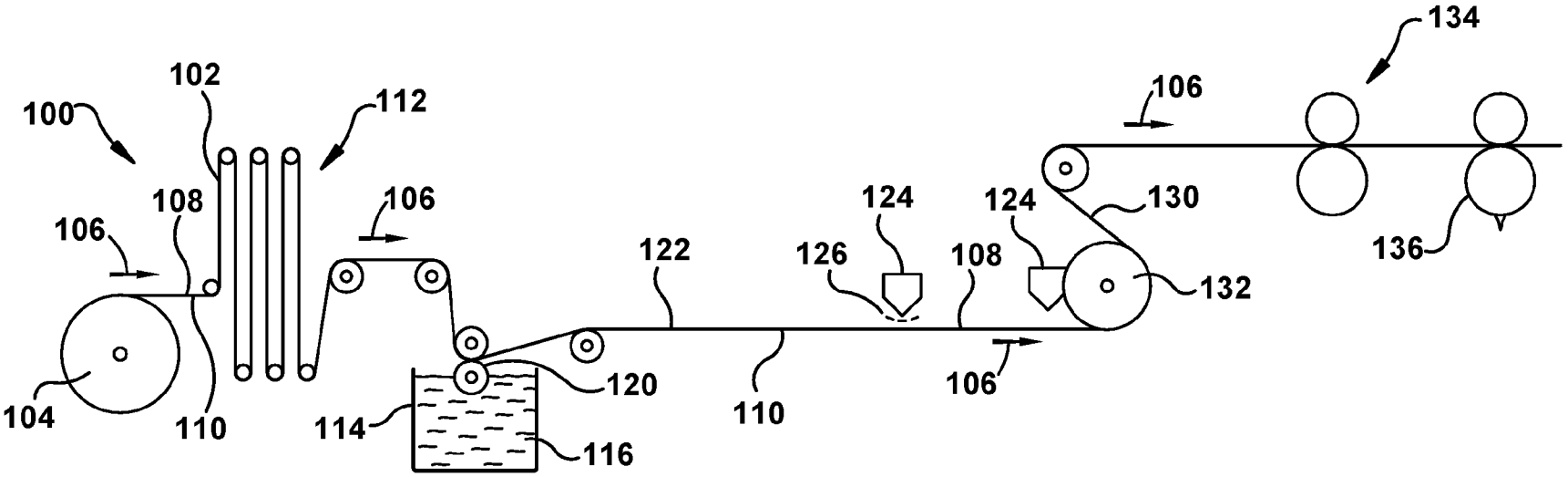
FIG. 1 is a schematic view of an exemplary embodiment of an apparatus and process for manufacturing roofing shingles.

The embodiments disclosed herein will now be described by reference to some more detailed embodiments, in view of the accompanying drawings. These embodiments may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements. Every numerical range given throughout this specification and claims will include every narrower numerical range that falls within such broader numerical range, as if such narrower numerical ranges were all expressly written herein.

As used in the description and the appended claims, the phrase "asphalt" is defined as any type of bituminous material suitable for use on a roofing material, such as asphalts, tars, pitches, or mixtures thereof. The asphalt may be either manufactured asphalt produced by refining petroleum or naturally occurring asphalt. The asphalt may include various additives and/or modifiers, such as inorganic fillers or mineral stabilizers, organic materials such as polymers, recycled streams, or ground tire rubber. Preferably, the asphalt contains asphalt and an inorganic filler or mineral stabilizer.

As used in the description of the invention and the appended claims, the term "longitudinal" or "longitudinally" is defined as substantially parallel with the machine direction. The terms "top" and "bottom", when used regarding the roofing material, are in reference to the roofing material when installed on a roof "Bottom" referring to the portion facing towards the roof deck and "top" referring to the portion facing away from the roof deck.

FIG. 1 illustrates an exemplary manufacturing process 100 for manufacturing roofing shingles according to the invention. In a first step of the manufacturing process, a continuous sheet of substrate or mat 102 is payed out from a roll 104 in a machine direction 106. The substrate 102 may be any material suitable for use in asphalt-based roofing materials. For example, the substrate 102 may be a type known for use in asphalt-based roofing materials, such as a nonwoven web of glass fibers, a scrim or felt of fibrous materials such as mineral fibers, cellulose fibers, rag fibers, mixtures of mineral and synthetic fibers, or the like. The substrate 102 includes a top side 108 and a bottom side 110. The sheet of substrate 102 is passed from the roll 104 through an accumulator 112. The accumulator 112 allows time for splicing one roll 104 of substrate to another, during which time the substrate 102 within the accumulator 112 is fed to the manufacturing process so that the splicing does not interrupt manufacturing.

The substrate 102 is then fed to a coater 114 where a hot asphalt coating 116 is applied to the substrate. The asphalt coating 116 may be applied in any suitable manner, such as, for example, sprayed, rolled or pumped onto the substrate 102. In an exemplary embodiment, the asphalt coating 116 is a conventional filled asphalt used on asphalt based shingles. In the exemplary embodiment, the asphalt coating 116 is applied to the substrate 102 prior to a pair of rollers 120 such that as the substrate 102 moves between the nip point of the two roller configuration 120, the rollers completely cover the substrate 102 with the asphalt coating 116 to form a first asphalt coated sheet 122. The asphalt coating 116 impregnates and saturates the substrate 102 and may form an asphalt layer on the top side 108 and the bottom side 110 of the substrate 102.

Next, the asphalt coated sheet 122 is passed beneath one or more granule dispensers 124 that apply granules 126 to the top side 108 of the asphalt coated sheet 122 to form a granule coated sheet 130. The granule dispensers 124 can be of any type suitable for depositing granules onto the asphalt coated sheet 122 and the granules can be any granulates suitable for use with roofing material. The granules 126 may be applied to the entire top side 108 of the asphalt coated sheet 122 or selectively to portions of the sheet.

The granule-coated sheet 130 is then turned around a slate drum 132 to press the granules 126 into the asphalt coating and to temporarily invert the sheet so that the excess granules will fall off and will be recovered and reused. After the granule-coated sheet 130 is turned around the slate drum 132, a backing agent (not shown), such as sand, may optionally be applied to the bottom side 108 of the granule-coated sheet 130 to the extent that the bottom side becomes entirely encapsulated. Release film (not shown) may optionally be applied to the bottom side 110 of the granule-coated sheet 130 while the sheet wraps around the slate drum 132 and prior to the application of the backing agent.

The granule-coated sheet 130 may also pass through a set of press rolls 134 to complete the embedment of the granules 126 into the filled asphalt coating and through a series of cooling steps after the press rolls and prior to being cut. The granule-coated sheet 130 is subsequently passed into contact with one or more rotary pattern cutters 136 that cut the granule-covered sheet 130 into individual, single-layer (substrate) shingles. Thus, the granule-covered sheet 130 acts as a parent sheet for the shingles formed from it.

Figure 2:
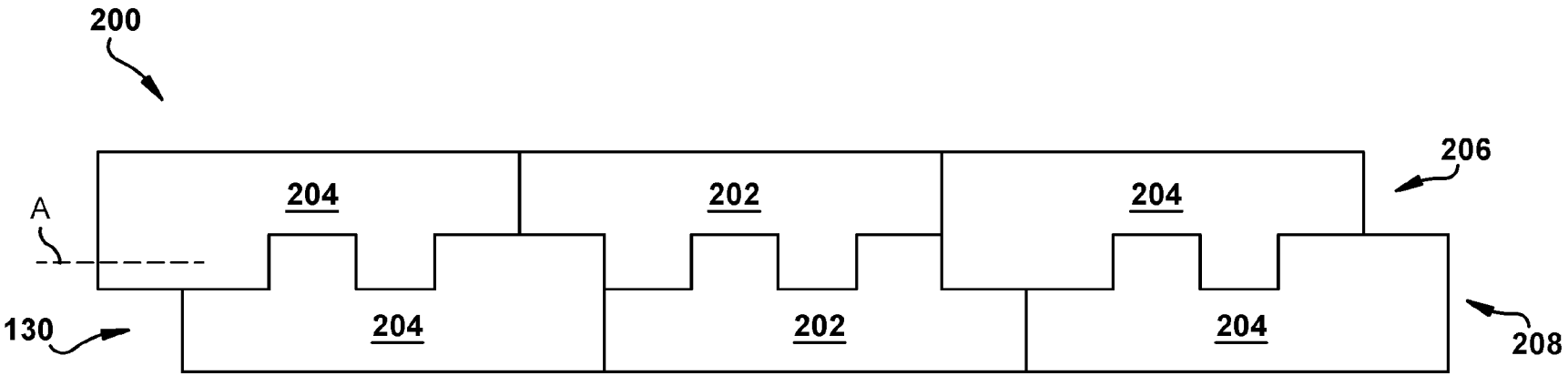
FIG. 2 is an exemplary embodiment of a shingle sheet sectioned into shingles of a roofing shingle system.

FIG. 2 shows an exemplary embodiment of a roofing shingle system 200. The roofing shingle system 200 includes two or more different shingle patterns designed to cooperate to provide a superior appearance to conventional three-tab shingles when installed on a roof. Each individual shingle pattern and the number of shingle patterns utilized in the roofing shingle system 200 may vary. In the illustrated exemplary embodiment in FIG. 2, the granule-coated sheet 130 is cut into one or more first shingles 202, which have a first shingle pattern, and one or more second shingles 204, which have a second shingle pattern that differs from the first shingle pattern. The granule-coated sheet 130 is sectioned into a first lane 206 of cut shingles and a second lane 208 of cut shingles that extend along a longitudinal axis A of the granule-coated sheet. Each of the first lane 206 and the second lane 208 alternate between a first shingle 202 and a second shingle 204 in the direction of the longitudinal axis A. In other embodiments, the granule-coated sheet 130 may be sectioned into more than two lanes. For example, the granule-coated sheet 130 may be sectioned into four lanes of cut shingles.

The first lane 206 of cut shingles and a second lane 208 of cut shingles are interwoven so that substantially no material from the granule-coated sheet 130 is scrap or waste. For the purpose of this disclosure, "substantially no scrap or waste material" refers to the interwoven shingle patterns utilizing substantially all of the granule-coated sheet material as part of the patterns. In other words, the perimeter of each shingle follows the perimeter of an adjacent shingle or forms an edge of the granule-coated sheet. Scrap or waste material, however, does not include material that would be removed, if any, by the rotary cutter as the cutter cuts along the perimeter of the shingle patterns, or excess material at the terminal end of a granule-coated sheet, or material discharged due to imperfections in the sheet or miscuttings, or similar circumstances resulting in the shingle not be deemed suitable for use.

Figure 3:
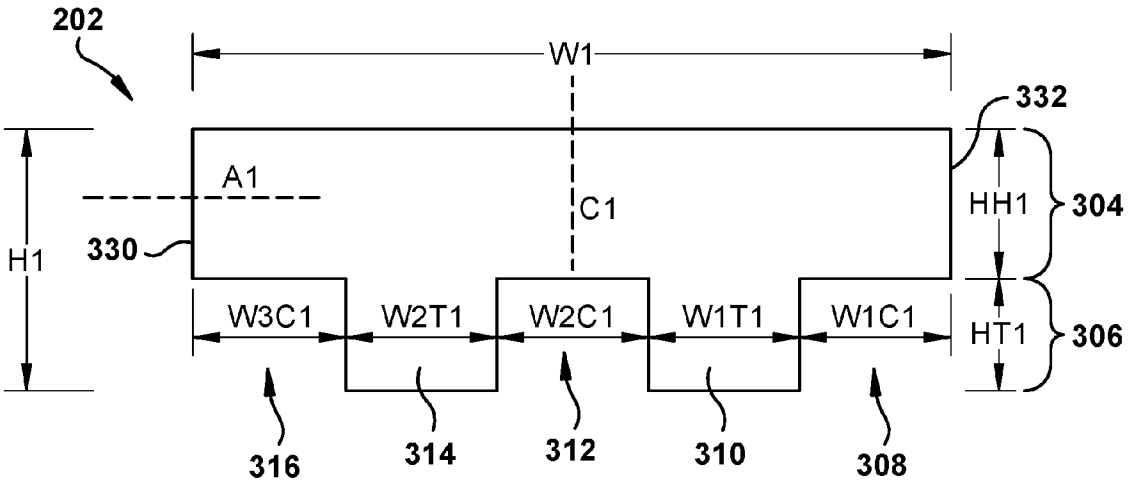
FIG. 3 is a top view of a first shingle of the roofing shingle system of FIG. 2.

Referring to FIG. 3, the first shingle 202 has a height H1, a width W1, and a longitudinal axis A1. The first shingle 202 includes a head portion 304 having a height HH1 and a tab portion 306 having a height HT1. The tab portion 306 includes a series of alternating tabs and cutouts. The tab portion 306 may include any number of alternating tabs and cutouts. In the illustrated embodiment, the tab portion 306 of the first shingle 202 includes a first cutout 308 having a width W1C1, a first tab 310 having a width W1T1, a second cutout 312 having a width W2C1, a second tab 314 having a width W2T1, and a third cutout 316 having a width W3C1. In the exemplary embodiment, the widths of the three cutouts W1C1, W2C1, W3C1 and the widths of the two tabs W1T1, W2T1 are substantially equal with the second cutout 312 centered along the width of the first shingle 202 bisecting a centerline C1. Thus, the first shingle 202 is symmetric about the centerline C1. In other embodiments, however, each cutout and tab may have different widths. In the exemplary embodiment, the height of each of the cutouts 308, 312, 316 and each of the tabs 310, 314 is equal to the tab portion height HT1. In other embodiments, however, each cutout and tab may have different heights. The first shingle 202 also includes a left edge 330 and a right edge 332. Left and right referring to the orientation of the first shingle as illustrated in FIG. 3.

Figure 4:
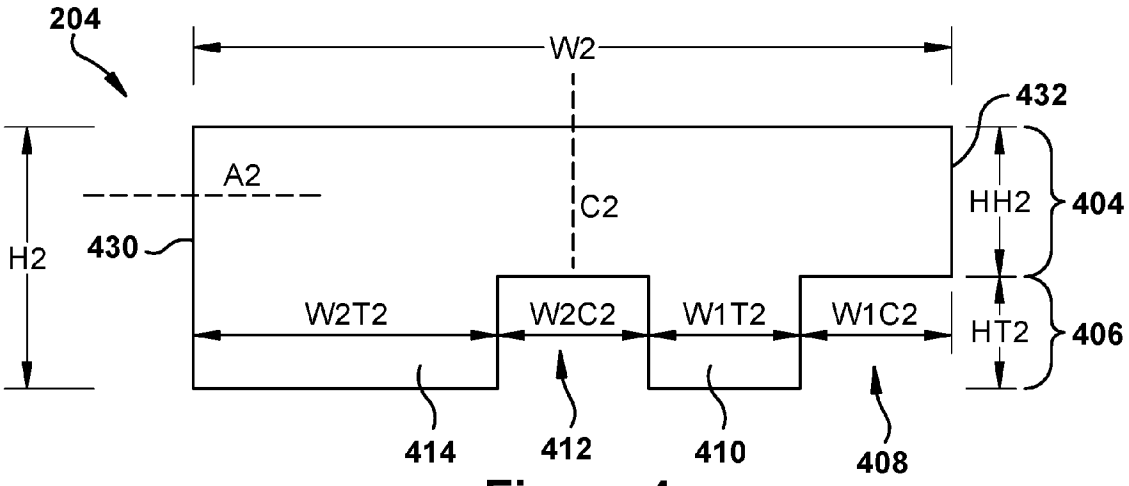
FIG. 4 is a top view of a second shingle of the roofing shingle system of FIG. 2.

Referring to FIG. 4, the second shingle 204 has a height H2, a width W2, and a longitudinal axis A2. The second shingle 204 includes a head portion 404 having a height HH2 and a tab portion 306 having a height HT2. In the exemplary embodiment, the height H2, the width W2, the head height HH2, and the tab portion height HT2 of the second shingle 204 may be substantially equal to the height H1, the width W1, the head height HH1, and the tab portion height HT1 of the first shingle 202, though in other embodiments, the height, the width, the head height, or the tab portion height of the second shingle may differ from the first shingle.

The tab portion 406 includes a series of alternating tabs and cutouts. The tab portion 406 may include any number of alternating tabs and cutouts. In the illustrated embodiment, the tab portion 406 of the second shingle 204 includes a first cutout 408 having a width W1C2, a first tab 410 having a width W1T2, a second cutout 412 having a width W2C2, and a second tab 414 having a width W2T2. In the exemplary embodiment, the first cutout width W1C2, the second cutout width W2C2, and the first tab width W1T2 are substantially equal with the second cutout 412 bisecting a centerline C2 of the second shingle 204. The second tab 414 has a width W2T2 that is about double (2×) the width W1T2 of the first tab 410, but in other embodiments, the second tab width W2T2 can be more than about double the first tab width W1T2 or less than about double the first tab width. The second shingle 204 does not include a third cutout similar to the third cutout 316 of the first shingle 202. In one exemplary embodiment, the first tab width W1T1 of the first shingle 202 is substantially equal to the first tab width W1T2 of the second shingle; however, in other embodiments, the first tab width W1T1 of the first shingle 202 may be greater or less than the first tab width W1T2 of the second shingle. Additionally, in one exemplary embodiment, the first cutout width W1C1 of the first shingle 202 is substantially equal to the first cutout width W1C2 of the second shingle; however, in other embodiments, the first cutout width W1C1 of the first shingle may be greater or less than the first cutout width W1C2 of the second shingle.

In the exemplary embodiment, the height of each of the cutouts 408, 412 and each of the tabs 410, 414 is equal to the tab portion height HT2. In other embodiments, however, each cutout and tab may have different heights. The second shingle 204 also includes a left edge 430 and a right edge 432. Left and right referring to the orientation of the first shingle as illustrated in FIG. 4. It will be understood that while the exemplary embodiment of the second shingle 204 is illustrated in FIG. 4 has having the second tab 414 to the left of the first tab 410, in other embodiments, the position of the first tab and second tab could be switched such that the second tab is to the right of the first tab as viewed in FIG. 4.

In an exemplary embodiment, the narrowest tab width of the shingle is substantially equal to one-fifth (20%) of the total width of the shingle. As an example, the width W1T2 of the first tab 410 of the second shingle 204 may be substantially equal to one fifth of the width W2 of the second shingle (e.g. W1T2=W2/5) and the width W2T2 of the second tab 414 may be two-fifths (40%) of the width W2 of the second shingle or double the width W1T2 of the first tab 410.

The width W1 of the first shingle 202 and the width W2 of the second shingle 204 may vary in different embodiments of the shingle system 200. Any suitable shingle width may be used. For example, in one exemplary embodiment, the first shingle 202 may have a width W1 of approximately 40 inches, a height H1 of about 13.25 inches, and the widths W1C1, W2C1, W3C1 of each of the cutouts 308, 312, 316 and the widths W1T1, W2T1 of each of the tabs 310, 314 may be approximately 8 inches. In another exemplary embodiment, the first shingle 202 may have a width W1 of approximately 39.375 inches and the widths W1C1, W2C1, W3C1 of each of the cutouts 308, 312, 316 and the widths W1T1, W2T1 of each of the tabs 310, 314 may be approximately 7.875 inches.

In an exemplary embodiment, the shingle system 200, the first shingle 202 has a width W1 of about 39.375 inches, a height H1 of about 13.25 inches, a head portion height HH1 of about 7.625 inches, a tab portion height of about 5.625 inches, and width of about 7.875 inches for each of the cutouts 308, 312, 316 and tabs 310, 314.

Figure 5:
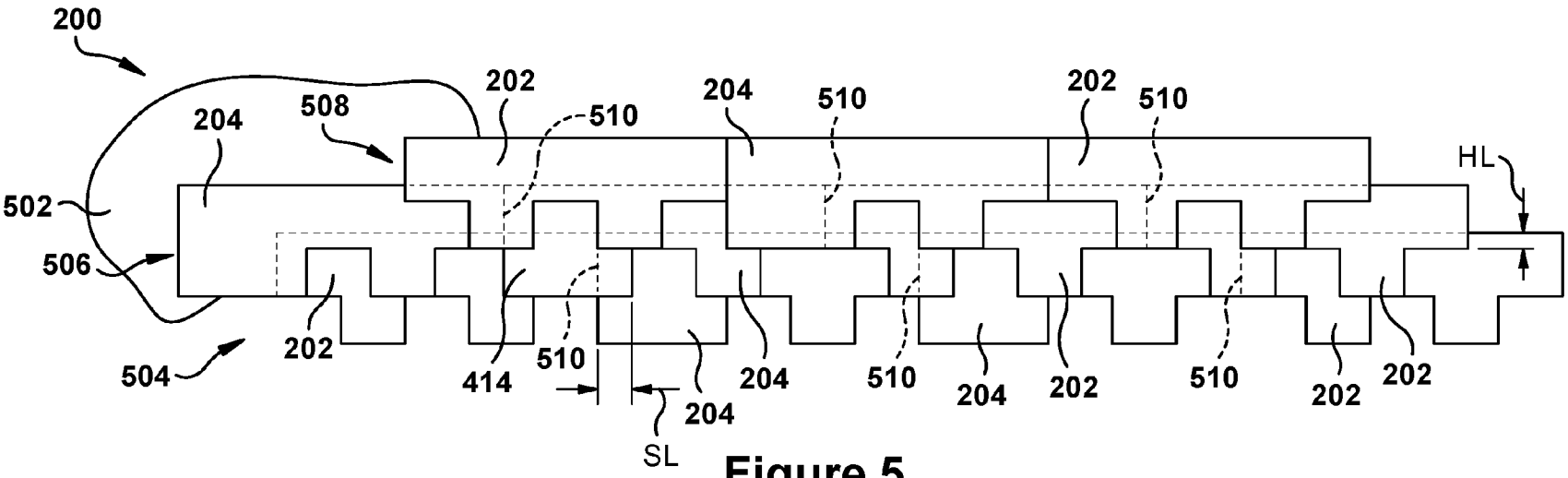
FIG. 5 is a partial top view of the roofing shingle system of FIG. 2 installed on a roof deck.

FIG. 5 illustrates a portion of the roofing shingle system 200 installed on a roof deck 502. Conventionally, roofing shingles are installed in overlapping rows of shingles (courses) running horizontally across the roof deck. An initial or starting course, usually just a horizontal strip of shingle material, starts at the bottom of the roof deck. Subsequent courses of shingles are layered over the previous course. In each course, adjacent shingles are aligned side-by-side such that the right edge of a shingle abuts the left edge of an adjacent shingle to form an edge joint. The next course of shingles is positioned such that the tab portion of the shingles overlays the head portion of the shingles of the previous course. For example, FIG. 5 illustrates an exemplary embodiment of the roofing shingle system 200 including a partial first course 504, a partial second course 506, and a partial third course 508 of first and second shingles 202, 204 (starter course not shown).

The exemplary embodiment of the roofing shingle system 200 is designed such that each course can include a random series of first shingles 202 and second shingles 204 arranged side-by-side while always having a tab of a shingle in a subsequent course overlay the edge joint 510 between two shingles in the previous course. The amount that the tab of a shingle in a subsequent course horizontally overlaps the edge joint 510 between two shingles in the previous course is referred to as sidelap SL. The amount that a shingle in a subsequent course vertically overlaps the head portion 304, 404 of the shingles in the previous course is referred to as headlap HL. During installation, as long as one shingle in the subsequent course is positioned such that a tab from that shingle overlays the edge joint in the previous course, preferably with a sidelap SL of about half the width of the narrowest tab, then the edge joints in the underlaying course will always be covered by a tab from the overlaying course, regardless of which shingles, or the order of the shingles, are laid.

For example, the first course 504, from left to right in FIG. 5, includes a first shingle 202, a second shingle 204, another second shingle 204, and a first shingle 202. The second course 506, from left to right in FIG. 5, includes a second shingle 204, another second shingle 204, a first shingle 202, and another first shingle 202. The third course 508, from left to right in FIG. 5, includes a first shingle 202, a second shingle 204, and a first shingle 202.

As shown in FIG. 5, the edge joints 510 in the first course 504 are covered by a tab from a shingle in the second course 506. For example, in the first course 504, the first two shingles from left to right in FIG. 5, are shown as a first shingle 202 next to a second shingle 204. The edge joint 510 between the first shingle 202 and the second shingle 204 is covered by the second tab 414 of a second shingle 204 in the second course 506. In the exemplary embodiment of the roofing shingle system 200, the system is designed for the sidelap SL to be about half of the first tab width W1T1. Having the edge joints covered by the overlaying shingle course and having sufficient sidelap improves the ability of the roofing shingle system to prevent water, such as driven rain water, from infiltrating past the shingles to the roof deck.

The headlap HL in the shingle system 200 may vary in different embodiments of the shingles. For example, in an exemplary embodiment in which the shingles have a width W1 of approximately 40 inches and a height H1 of about 13.25 inches, the headlap HL may be approximately 2 inches.

Figure 6:
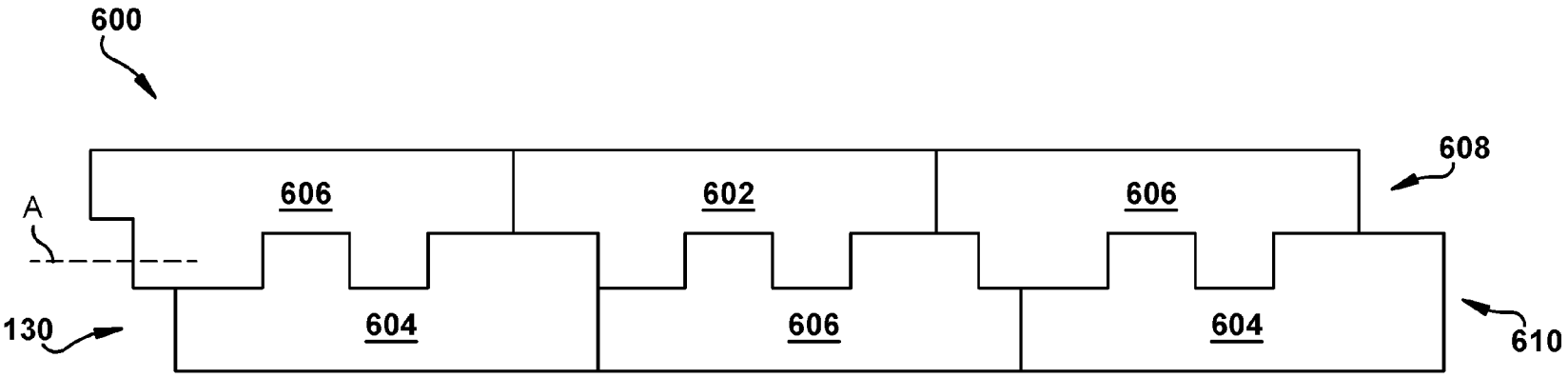
FIG. 6 is an exemplary embodiment of a shingle sheet sectioned into shingles of a roofing shingle system.

FIG. 6 shows an exemplary embodiment of a roofing shingle system 600. The roofing shingle system 600 is similar to the roofing shingle system 200 in that the granule-coated sheet 130 is cut into one or more first shingles 602, which have substantially the same shingle pattern as the first shingle 202 of the roofing shingle system 200, and one or more second shingles 604, which have substantially the same shingle pattern as the second shingle 204 of the roofing shingle system 200. The roofing shingle system 600, however, includes one or more third shingles 606, which have a third shingle pattern that differs from the shingle pattern of the first shingle 602 and the second shingle 604. In the exemplary embodiment, the granule-coated sheet 130 is sectioned into a first lane 608 of cut shingles and a second lane 610 of cut shingles that extend along a longitudinal axis A of the granule-coated sheet. The first lane 608 of cut shingles alternates between the first shingle 602 and the third shingle 606 in the direction of the longitudinal axis A and the second lane 610 alternates between the second shingle 604 and the third shingle 606 in the direction of the longitudinal axis A. The first lane 608 of cut shingles and a second lane 610 of cut shingles are interwoven so that substantially no material from the granule-coated sheet 130 is scrap or waste. In other embodiments, the granule-coated sheet 130 may be sectioned into more than two lanes. For example, the granule-coated sheet 130 may be sectioned into four lanes of cut shingles.

Figure 7:
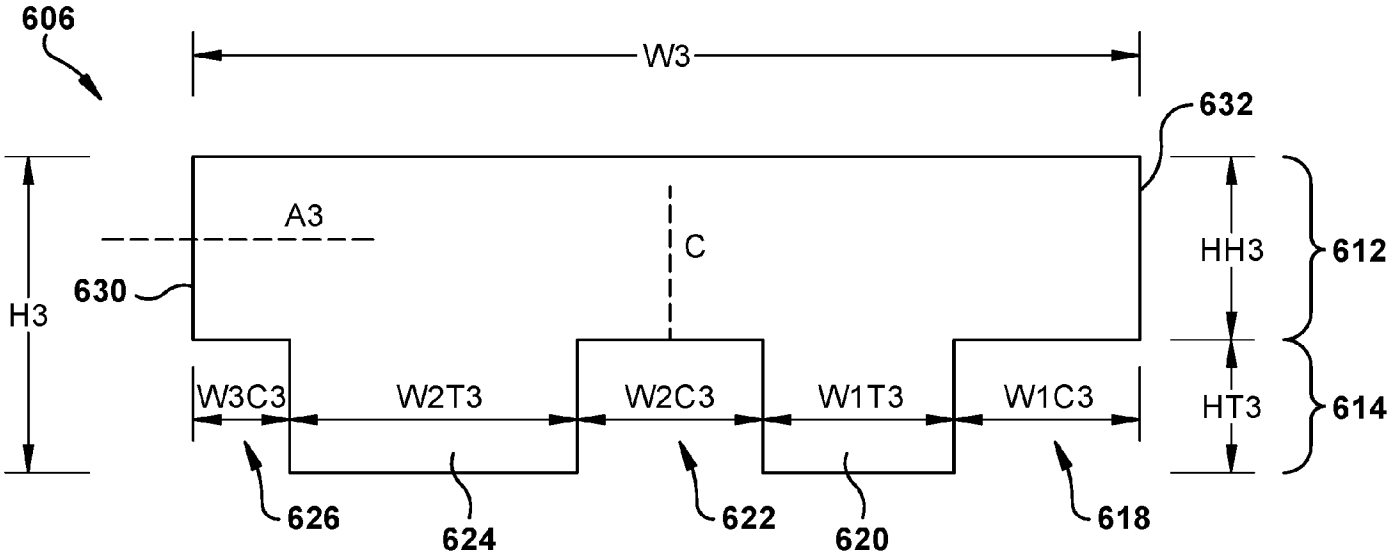
FIG. 7 is a top view of a second shingle of the roofing shingle system of FIG. 6.

Referring to FIG. 7, the third shingle 606 has a height H3, a width W3, and a longitudinal axis A3. The third shingle 606 includes a head portion 612 having a height HH3 and a tab portion 614 having a height HT3. In the exemplary embodiment, the height H3, the width W3, the head height HH3, and the tab portion height HT3 of the third shingle 606 may be substantially equal to the height H1, the width W1, the head height HH1, and the tab portion height HT1 of the first shingle 602, which has substantially the same shingle pattern as the first shingle 202. In other embodiments, however, the height, the width, the head height, or the tab portion height of the third shingle may differ from the first shingle and the second shingle.

The tab portion 614 includes a series of alternating tabs and cutouts. The tab portion 614 may include any number of alternating tabs and cutouts. In the illustrated embodiment, the tab portion 614 of the third shingle 606 includes a first cutout 618 having a width W1C3, a first tab 620 having a width W1T3, a second cutout 622 having a width W2C3, a second tab 624 having a width W2T3, and a third cutout 626 having a width W3C3. In the exemplary embodiment, the first cutout width W1C3, the second cutout width W2C3, and the first tab width W1T3 are substantially equal with the second cutout 622 bisecting a centerline C3 of the third shingle 606.

The second tab 624 has a width W2T3 that is about one-and-one-half (1.5×) the width W1T3 of the first tab 620, but in other embodiments, the second tab width W2T3 can be more than about one-and-one-half the first tab width W1T3 or less than about one-and-one-half the first tab width. The third cutout 626 has a width W3C3 that is about half (0.5×) of the width W1T3 of the first tab 620, but in other embodiments, the third cutout width W3C3 can be more than about half of the first tab width W1T3 or less than about half of the first tab width. In other embodiments, however, each cutout and tab may have different heights. In one exemplary embodiment, the first tab width W1T3 of the third shingle 606 is substantially equal to the first tab width W1T1 of the first shingle 602, though that is not required. Additionally, in one exemplary embodiment, the first cutout width W1C3 of the third shingle 606 is substantially equal to the first cutout width W1C1 of the first shingle 602, though that is not required.

In the exemplary embodiment, the height of each of the cutouts 618, 622, 626 and each of the tabs 620, 624 is equal to the tab portion height HT3. In other embodiments, however, each cutout and tab may have different heights. The third shingle 606 also includes a left edge 630 and a right edge 632. Left and right referring to the orientation of the third shingle as illustrated in FIG. 7. It will be understood that while the exemplary embodiment of the third shingle 606 is illustrated in FIG. 7 as having the second tab 624 to the left of the first tab 620, in other embodiments, the position of the first tab and second tab could be switched such that the second tab is to the right of the first tab as viewed in FIG. 7.

Figure 8:
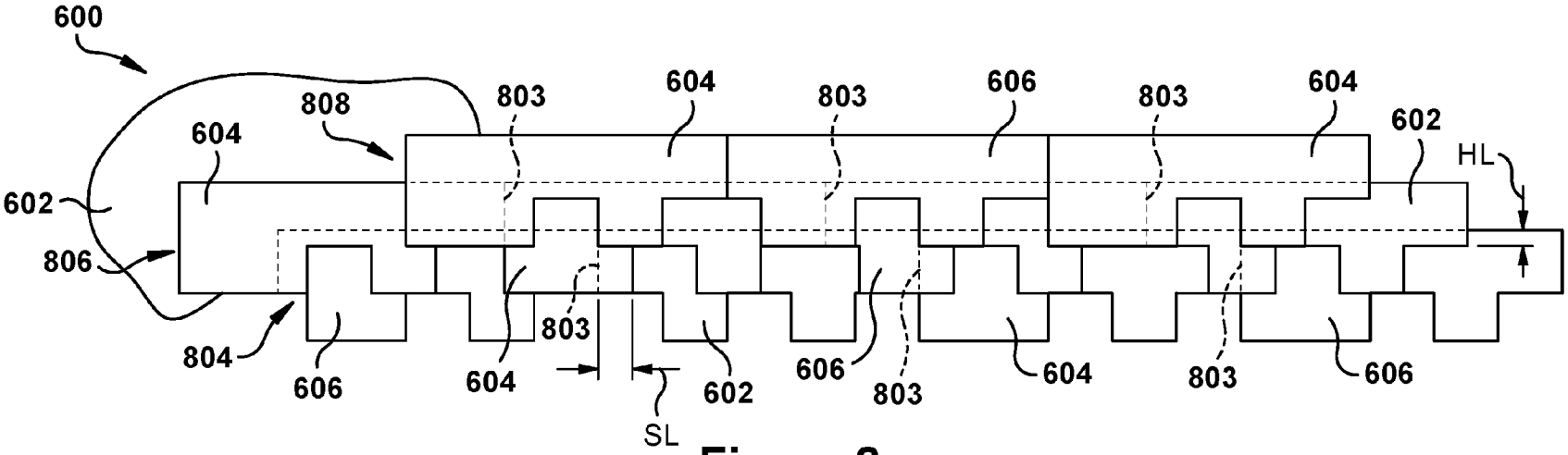
FIG. 8 is a partial top view of the roofing shingle system of FIG. 6 installed on a roof deck.

FIG. 8 illustrates a portion of the roofing shingle system 600 installed on a roof deck 802. The installation of the exemplary embodiment of the roofing shingle system 600 is similar to the roofing shingle system 200 shown in FIG. 5 in that the roofing shingle system 600 is designed such that each course can include a random series shingles 204 arranged side-by-side while always having a tab of a shingle in a subsequent course, overlay each edge joint 803 between two shingles in the previous course. The roofing shingle system 600, however, includes the third shingle 606 in addition to the first shingle 602 and the second shingle 604.

FIG. 8 illustrates an exemplary embodiment of the roofing shingle system 600 including a partial first course 804, a partial second course 806, and a partial third course 808 of first shingles 602, second shingles 604, and third shingles 606 (starter course not shown). The first course 804, from left to right in FIG. 8, includes a third shingle 606, a first shingle 602, a second shingle 604, and a third shingle 606. The second course 806, from left to right in FIG. 8, includes a second shingle 606, another second shingle 604, a third shingle 606, and a first shingle 602. The third course 808, from left to right in FIG. 8, includes a second shingle 604, a third shingle 606, and a second shingle 604.

As with the roofing shingle system 200, the edge joints 810 in the first course 804 are covered by a tab from a shingle in the second course 806 and so on. Thus, during installation, as long as one shingle in the subsequent course is positioned such that a tab from that shingle overlays the edge joint in the previous course, preferably with a sidelap SL of about half the width of the narrowest tab, then the edge joints in the underlaying course will always be covered by a tab from the overlaying course, regardless of which shingles, or the order of the shingles, are laid. Further, the roofing shingle system 600 is designed for a sidelap SL to be about half of the first tab width W1T1; however, in other embodiments, the a sidelap SL may be more than or less than half of the first tab width W1T1.

Conventional three-tab shingles typically have a height of 12 inches and a width of 32 inches. When installed on a roof, about 6 inches of the shingle is exposed with the remaining height of the shingle being overlapped by the next course of shingles (i.e. 6 inches of headlap). As a result, of the 432 $in^2$ of the upper face, 216 $in^2$ are exposed and 216 $in^2$ are covered (50% exposed). Conventional laminate shingles typically have a height of 13.25 inches and a width of 39.375 inches. When installed on a roof, about 5.625 inches of the shingle is exposed with the remaining height of the shingle being overlapped by the next course of shingles (i.e. 7.625 inches of headlap). As a result, of the 521.72 $in^2$ of the upper face, 221.48 $in^2$ are exposed (about 42.5% exposed).

As compared to conventional three-tab and laminate shingles, the shingles of the roofing shingle system 200 and the roofing shingle system 600 have a higher ratio of area that can potentially be exposed when installed as intended. Unlike conventional three-tab and laminate shingles which always have approximately the same exposed area, the different shingle patterns and the potential random ordering of shingles in the roofing shingle systems 200, 600, may result in a different amount of exposed area from shingle to shingle.

For example, the shingle 202 of FIG. 3, in one exemplary embodiment, has a height of 13.25 inches, a width of 40 inches and includes three cutouts, each with a width of 8 inches and a height of 5.625 inches, resulting in an upper face area of 315 $in^2$. In one exemplary embodiment, the headlap HL is approximately 2 inches and the sidelap SL for each shingle along each of the edge joints is approximately 2 inches, resulting in a total of 102 $in^2$ of upper face area that will be overlapped regardless of the random selection of shingles used. As a result, of the total of 315 $in^2$ of upper face area, any portion of the remaining 213 $in^2$ may be exposed as a result of the random selection of shingles (about 67.6% exposable when installed as intended). For shingle 606 of FIG. 7 and shingle 204 of FIG. 4, the percent exposable when installed as intended increases to 74.8% and 81.9%, respectively. The percentages may change in various embodiments of the shingles and the amount of headlap and sidelap used. In one exemplary embodiment of a shingle system, the percentage of the upper face area exposable when installed as intended is greater than 60%.

Figure 9:
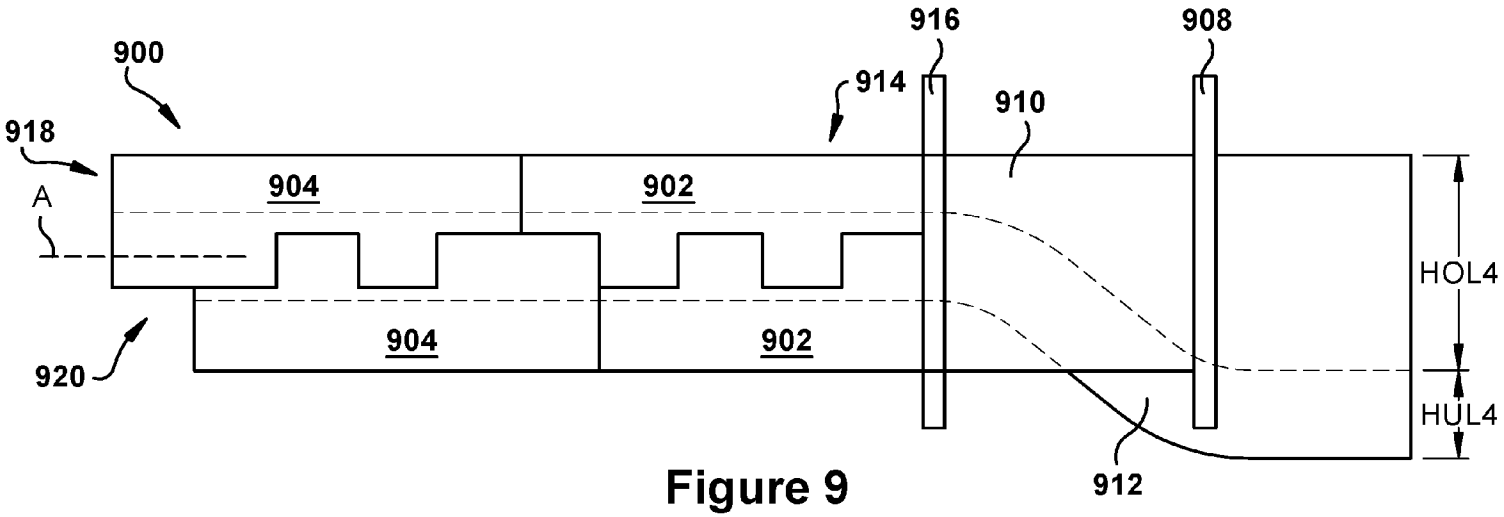
FIG. 9 is an exemplary embodiment of a shingle sheet sectioned into shingles of a roofing shingle system.

FIG. 9 illustrates an exemplary embodiment of a roofing shingle system 900. The roofing shingle system 900 is similar to the roofing shingle system 200 of FIG. 2 or the roofing shingle system 600 of FIG. 6 in that the roofing shingle system includes two or more different shingle patterns designed to cooperate to provide a superior appearance to conventional three-tab shingles when installed on a roof. In the illustrated embodiment, the roofing shingle system 900 includes one or more first shingles 902, which have a first shingle pattern, and one or more second shingles 904, which have a second shingle pattern that differs from the first shingle pattern. The exemplary embodiment of the roofing system 900, however, differs from the exemplary embodiment of the roofing systems 200, 600 in that the first and second shingles 902, 904 in the exemplary embodiment of the roofing system 900 are laminated.

In the illustrated embodiment of FIG. 9, a granule-coated sheet 906 may be manufactured in a similar manner as described in FIG. 1 or any other suitable asphalt shingle manufacturing method, such as for example, laminate shingle manufacturing methods. In the exemplary embodiment of FIG. 9, the granule-coated sheet 906 acts as a parent sheet for the shingles formed from it. The granule-coated sheet 906 is passed into contact with a rotary cutter 908 that cuts the granule-coated sheet 906 into an overlay sheet 910 having a height HOL4 and an underlay sheet 912 having a height HUL4. Once separated, the underlay sheet 912 may be directed to be aligned beneath the overlay sheet 910. In the illustrated embodiment, the underlay sheet 912 is aligned beneath the overlay sheet 910 such that the underlay sheet 912 is centered on a central longitudinal axis A of the overlay sheet 910. The underlay sheet 912 is then attached to the overlay sheet 910 to form a continuous laminated sheet 914.

The overlay sheet 910 may be attached to the underlay sheet 912 by any suitable manner, such as for example, by a laminate adhesive, as is known in the art. In one exemplary embodiment, the laminate adhesive is applied to the underside of the overlay sheet 910 after the granule-coated sheet 906 is passed into contact with the rotary cutter 908. In other embodiments, however, the laminate adhesive is applied to the underside of the overlay sheet 910 prior to the rotary cutter 908.

The continuous laminated sheet 914 is subsequently passed into contact with one or more rotary pattern cutters 916 that cut continuous laminated sheet 914 through both the overlay sheet 910 and the underlay sheet 912 to section the continuous laminated sheet 914 into a first lane 918 of cut shingles and a second lane 920 of cut shingles that extend along the longitudinal axis A. Each of the first lane 918 and the second lane 920 alternate between the first shingle 902 and a second shingle 904 in the direction of the longitudinal axis A. In other embodiments, the continuous laminated sheet 914 may be cut to include more than two shingle patterns. For example, the continuous laminated sheet 914 may be cut similar to the sheet 600 of FIG. 6 to include one or more third shingles (not shown), which have a third shingle pattern that differs from the shingle pattern of the first shingle 902 and the second shingle 904.

The overlay sheet 910 and the underlay sheet 912 are adjacent each other on the granule-coated sheet 906 and the first lane 918 of cut shingles and a second lane 920 of cut shingles are interwoven. Thus, substantially no material from the granule-coated sheet 906 is scrap or waste. For the purpose of this disclosure, "substantially no scrap or waste material" refers to the interwoven shingle patterns and underlay sheet utilizing substantially all of the granule-coated sheet material as part of the formed shingles. Scrap or waste material, however, does not include material that would be removed, if any, by the rotary cutter as the cutter cuts along the perimeter of the shingle patterns, or excess material at the terminal end of a granule-coated sheet, or material discharged due to imperfections in the sheet or miscuttings, or similar circumstances resulting in the shingle not be deemed suitable for use.

The first shingle 902 and the second shingle 904 have a substantially similar shingle pattern to the first shingle 202 and the second shingle 204 of the shingle system 200, thus the description of the shingle pattern of the first shingle 202 and the second shingle 204 apply equally to the first shingle 902 and the second shingle 904 of FIG. 9.

Figure 10:
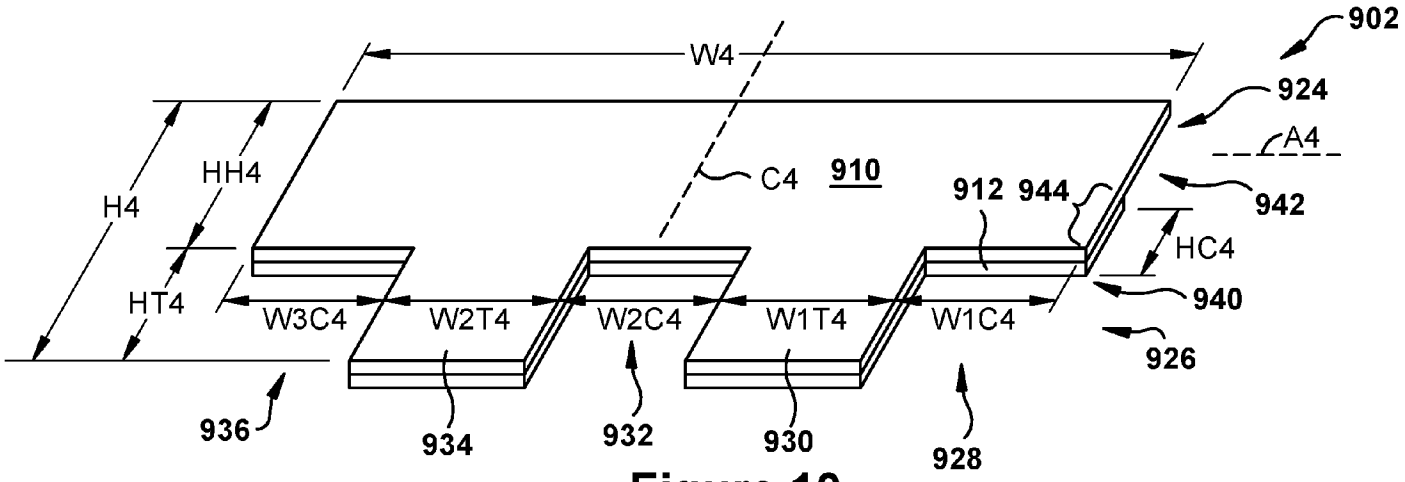
FIG. 10 is a perspective view of an exemplary embodiment of a shingle of the roofing shingle system of FIG. 9.

FIG. 10 illustrates an exemplary embodiment of the first shingle 902. The first shingle 902 has a height H4, a width W4, and a longitudinal axis A4. The first shingle 902 includes a head portion 924 having a height HH4 and a tab portion 926 having a height HT4. The tab portion 926 includes a series of alternating tabs and cutouts. The tab portion 926 may include any number of alternating tabs and cutouts. In the illustrated embodiment, the tab portion 926 of the first shingle 902 includes a first cutout 928 having a width W1C4, a first tab 930 having a width W1T4, a second cutout 932 having a width W2C4, a second tab 934 having a width W2T4, and a third cutout 936 having a width W3C4. In the exemplary embodiment, the widths of the three cutouts W1C4, W2C4, W3C4 and the widths of the two tabs W1T4, W2T4 are substantially equal with the second cutout 932 centered along the width of the first shingle 902 bisecting a centerline C4. Thus, the first shingle 902 is symmetric about the centerline C4. In other embodiments, however, each cutout and tab may have different widths. In the exemplary embodiment, the height of each of the cutouts 928, 932, 936 and each of the tabs 930, 934 is equal to the tab portion height HT4. In other embodiments, however, each cutout and tab may have different heights.

The overlay sheet 910 is disposed on and adhered to the underlay sheet 912 thereby defining both a two-layer portion 940 of the first shingle 902 and a single-layer portion 942 of the laminated shingle. The area of the overlay sheet 910 that overlaps the underlay sheet 912 in the head portion 924 is the common bond area 944. The height HC4 of the common bond area 944 may be vary in different embodiments of the shingle.

In an exemplary embodiment, the shingle system 900, the first shingle 902 has a width W4 of about 39.375 inches, a height H4 of about 13.25 inches, a head portion height HH4 of about 7.625 inches, a tab portion height HT4 of about 5.625 inches, width of about 7.875 inches for each of the cutouts 928, 932, 936 and tabs 930, 934, and a common bond area height HC4 of about 1.0 inch. The overlay sheet 918 has a height HOL4 of about 20.125 inches and the underlay sheet 920 has a height HUL4 of about 7.625 inches.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to asphalt based roofing material. Thus, for example, use of the inventive concepts to various roofing materials, such as for example roofing shingles and commercial roofing that is non-asphalt based, are within the spirit and scope of the general inventive concepts. It is sought, therefore, to cover all such changes and modifications as fall within the spirit and scope of the generally inventive concepts, as described and claimed herein, and equivalents thereof.

The invention claimed is:

1. A roofing system, comprising:

a plurality of first shingles having two tabs arranged in a first two-tab shingle pattern including a first tab having a first width spaced apart from a second tab having a second width by a first cutout having a first cutout width substantially equal to the first width, wherein the first width and the second width are substantially equal; and a plurality of second shingles having two tabs arranged in a second two-tab shingle pattern including a third tab having a third width spaced apart from a fourth tab having a fourth width by a second cutout having a second cutout width substantially equal to the third width, wherein the third width is substantially equal to the first width and the fourth width is about double the second width;

wherein the plurality of first shingles and the plurality of second shingles can be formed from a rectangular shingle blank in an interwoven pattern with substantially no scrap or waste material.

2. The roofing system of claim 1, wherein the first cutout is centered on a centerline of the first shingle and the second cutout is centered on a centerline of the second shingle.

3. The roofing system of claim 1, further comprising a third shingle having two tabs arranged in a third two-tab shingle pattern including a fifth tab having a fifth width and a sixth tab having a sixth width, wherein the fifth width is substantially equal to the first width and the sixth width is about 1.5 times the second width.

4. The roofing system of claim 3, wherein the third shingle includes a third cutout separating the fifth tab and the sixth tab, the third cutout having a third cutout width that is substantially equal to the first cutout width.

5. The roofing system of claim 4, wherein the third cutout is centered on a centerline of the third shingle.

6. The roofing system of claim 3, wherein the interwoven pattern includes a first lane of shingles and a second lane of shingles, wherein the first lane of shingles has alternating shingles of the first and third shingles and the second lane has alternating shingles of the second and third shingles.

7. The roofing system of claim 1, wherein the interwoven pattern includes a first lane of shingles and a second lane of shingles, wherein the first and second lane of shingles have alternating shingles of the first and second shingles.

8. The roofing system of claim 1, wherein each of the plurality of first shingles has a total width and the first width is substantially one-fifth of the total width.

9. A roofing shingle system for covering a roof, comprising:

a plurality of first shingles having two tabs arranged in a first two-tab shingle pattern including a head portion and a tab portion, the tab portion including a series of tabs and cutouts separating the tabs;

a plurality of second shingles having two tabs arranged in a second two-tab shingle pattern different than the first shingle pattern, the second shingle pattern including a head portion and a tab portion, the tab portion including a series of tabs and cutouts separating the tabs;

a plurality of third shingles having two tabs arranged in a third two-tab shingle pattern different than the first shingle pattern and the second shingle pattern, the third shingle pattern including a head portion and a tab portion, the tab portion including a series of tabs and cutouts separating the tabs;

a first course of shingles arranged on the roof including a random selection of the first, second, and third shingles arranged side-by-side to form edge joints between the shingles; and a second course of shingles arranged on the roof deck overlaying the head portions of the first, second, or third shingles on the first course, the second course of shingles including a random selection of the first, second, and third shingles arranged side-by-side;

wherein at least one of the tabs of the first shingle, at least one of the tabs of the second shingle, and at least one of the tabs of the third shingle all have a tab width that is the same;

wherein at least one of the cutouts of the first shingle, at least one of the cutouts of the second shingle, and at least one of the cutouts of the third shingle all have a width equal to the tab width; and wherein regardless of the random order of the first course of shingles and the second course of shingles, the edge joints in the first course of shingles are covered by a tab on a shingle in the second course of shingles.

10. The roofing system of claim 9, wherein the second course of shingles includes tabs of a first width and tabs of a second width, and a sidelap distance between an edge of a shingle of the first course and an edge of a shingle of the second course is equal to about half of the smaller of the first width and the second width.

* * * * *